US011649998B2

(12) United States Patent
Oyama

(10) Patent No.: US 11,649,998 B2
(45) Date of Patent: May 16, 2023

(54) CRYOCOOLER

(71) Applicant: SUMITOMO HEAVY INDUSTRIES, LTD., Tokyo (JP)

(72) Inventor: Shuji Oyama, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 69 days.

(21) Appl. No.: 17/014,542

(22) Filed: Sep. 8, 2020

(65) Prior Publication Data

US 2020/0400356 A1 Dec. 24, 2020

Related U.S. Application Data

(63) Continuation of application No. PCT/JP2019/009601, filed on Mar. 11, 2019.

(30) Foreign Application Priority Data

Mar. 23, 2018 (JP) ..... JP2018-056178

(51) Int. Cl.
*F25B 49/02* (2006.01)
*F04B 37/08* (2006.01)
(Continued)

(52) U.S. Cl.
CPC ..... *F25B 49/022* (2013.01); *F04B 37/08* (2013.01); *F04B 49/08* (2013.01); *F25B 9/14* (2013.01); *F25B 2400/075* (2013.01)

(58) Field of Classification Search
CPC ... F25B 49/022; F25B 2400/075; F04B 37/08
See application file for complete search history.

(56) References Cited

U.S. PATENT DOCUMENTS 9,759,467 B2 9/2017 Kimura
10,047,977 B2 8/2018 Hamasaki et al.
(Continued)

FOREIGN PATENT DOCUMENTS

JP S63266179 A * 11/1988
JP H03-125861 A 5/1991
(Continued)

OTHER PUBLICATIONS

Masakazu, Operation Control Method for Compressor of Refrigerator, 1988, Full Document (Year: 1988).*
(Continued)

*Primary Examiner* — Nael N Babaa
(74) *Attorney, Agent, or Firm* — Michael Best & Friedrich LLP

(57) ABSTRACT

A cryocooler includes a cold head, a plurality of compressor main bodies that are connected to the cold head in parallel, a plurality of state detection sensors that are provided to correspond to the plurality of compressor main bodies respectively and each detect a state of a corresponding compressor main body to output a state detection signal, and a compressor control unit that is configured to, in a case where the state detection signal from any one state detection sensor of the plurality of state detection sensors indicates that the corresponding compressor main body is stopped, stop also the other compressor main bodies.

7 Claims, 5 Drawing Sheets

(51) Int. Cl.
*F04B 49/08* (2006.01)
*F25B 9/14* (2006.01)

(56) References Cited

U.S. PATENT DOCUMENTS

| | | | | |
|---|---|---|---|---|
| 2002/0026801 | A1* | 3/2002 | Yamashita | B60H 1/3205 62/181 |
| 2006/0112705 | A1* | 6/2006 | Jin | F25B 49/022 62/510 |
| 2013/0160468 | A1* | 6/2013 | Kimura | F25B 9/14 62/6 |
| 2015/0330690 | A1* | 11/2015 | Goel | F25B 7/00 62/175 |
| 2018/0306491 | A1* | 10/2018 | Saunders | F25B 49/005 |

FOREIGN PATENT DOCUMENTS

| | | | |
|---|---|---|---|
| JP | 2011-094921 | A | 5/2011 |
| JP | 2013-134020 | A | 7/2013 |
| JP | 2015-061993 | A | 4/2015 |

OTHER PUBLICATIONS

International Search Report issued in Application No. PCT/JP2019/009601, dated May 21, 2019.

* cited by examiner

10

10

CRYOCOOLER

RELATED APPLICATIONS

The contents of Japanese Patent Application No. 2018-056178, and of International Patent Application No. PCT/JP2019/009601, on the basis of each of which priority benefits are claimed in an accompanying application data sheet, are in their entirety incorporated herein by reference.

BACKGROUND

Technical Field

Certain embodiment of the present invention relates to a cryocooler.

Description of Related Art

A cryocooler including a compressor and an expander, which is also called a cold head, is known in the related art. The compressor compresses a working gas of the cryocooler to a high pressure and supplies the working gas to the expander. The working gas is expanded by the expander to generate cold. The expansion decreases a pressure of the working gas. The low-pressure working gas is collected in the compressor and is compressed again.

SUMMARY

According to an aspect of the present invention, there is provided a cryocooler including a cold head, a plurality of compressor main bodies that are connected to the cold head in parallel, a plurality of state detection sensors that are provided to correspond to the plurality of compressor main bodies respectively and each detect a state of a corresponding compressor main body to output a state detection signal, and a compressor control unit that is configured to, in a case where the state detection signal from any one state detection sensor of the plurality of state detection sensors indicates that the corresponding compressor main body is stopped, stop also the other compressor main bodies.

Any combination of the components, or a configuration where the components or expressions of the present invention are mutually substituted between methods, devices, systems is also effective as an aspect of the present invention.

DETAILED DESCRIPTION

The present inventor has carried out intensive studies on a cryocooler in which a plurality of compressors are connected to one cold head in parallel, and as a result, has come to recognize the following problems. The design of such a cryocooler is suitable for a cryocooler having a large cold head that provides a large cooling capacity since a working gas can be supplied at a high flow rate to the cold head by simultaneously operating a plurality of compressors.

When a situation where one of the plurality of compressors stops abnormally for some reasons is assumed, the working gas can flow back from the operating compressor to the stopped compressor since the other compressor continues to operate normally at this time. Backflow is not desirable since the backflow can have an adverse effect on components of the compressor. By adding a backflow countermeasure component, such as a check valve, to the compressor, the backflow can be prevented or mitigated. However, since such a backflow countermeasure can cause a pressure loss in forward flow of the working gas, a cooling performance of the cryocooler can be decreased. In addition, the addition of a new component causes a rise in manufacturing costs.

It is desirable to provide a countermeasure against the backflow of the working gas while suppressing a rise in manufacturing costs for the cryocooler having the plurality of compressors.

Hereinafter, an embodiment for carrying out the present invention will be described in detail with reference to the drawings. In the description and drawings, the same or equivalent components, members, and processes will be assigned with the same reference signs, and redundant description will be omitted as appropriate. The scales and shapes of the illustrated parts are set for convenience in order to make the description easy to understand, and are not to be understood as limiting unless stated otherwise. The embodiment is merely an example and does not limit the scope of the present invention. All characteristics and combinations to be described in the embodiment are not necessarily essential to the invention.

Figure 1:
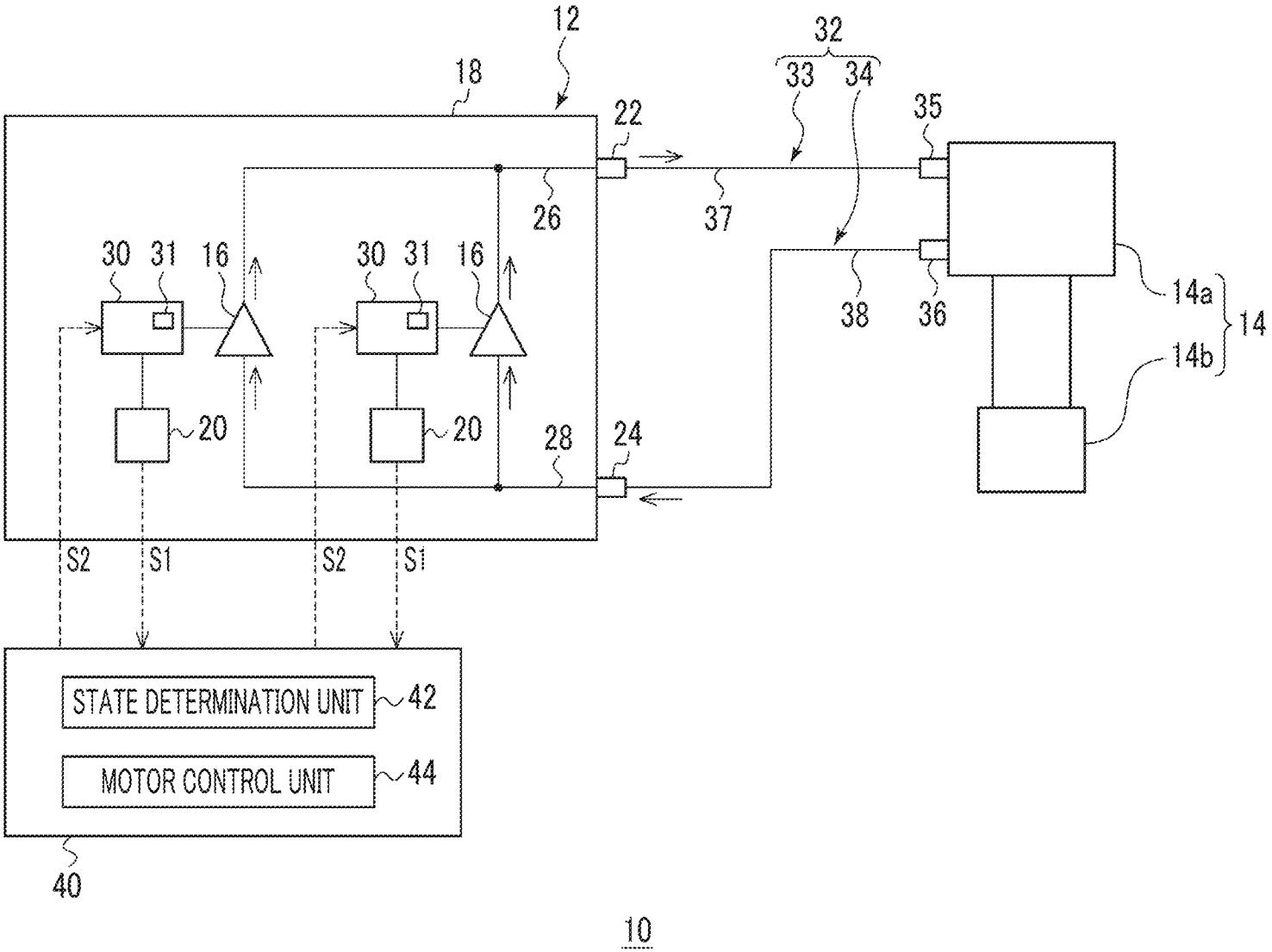
FIG. 1 is a diagram schematically showing a cryocooler according to one embodiment.

FIG. 1 is a diagram schematically showing a cryocooler 10 according to the embodiment.

The cryocooler 10 includes a compressor 12 and a cold head 14. The compressor 12 is configured to collect a working gas of the cryocooler 10 from the cold head 14, to pressurize the collected working gas, and to supply the working gas to the cold head 14 again. The cold head 14 is also called an expander and has a room temperature section 14*a* and a low-temperature section 14*b* which is also called a cooling stage. The compressor 12 and the cold head 14 configure a refrigeration cycle of the cryocooler 10, and thereby the low-temperature section 14*b* is cooled to a desired cryogenic temperature. The working gas is also called a refrigerant gas, and other suitable gases may be used although a helium gas is typically used. To facilitate understanding, a direction in which the working gas flows is shown with an arrow in FIG. 1.

Although the cryocooler 10 is, for example, a single-stage or two-stage Gifford-McMahon (GM) cryocooler, the cryocooler may be a pulse tube cryocooler, a Sterling cryocooler, or other types of cryocoolers. Although the cold head 14 has a different configuration depending on the type of the cryocooler 10, the compressor 12 can use the configuration described below regardless of the type of the cryocooler 10.

In general, both of a pressure of the working gas to be supplied from the compressor 12 to the cold head 14 and a pressure of the working gas to be collected from the cold head 14 to the compressor 12 are considerably higher than the atmospheric pressure, and can be called a first high pressure and a second high pressure, respectively. For convenience of description, the first high pressure and the second high pressure will also be simply referred to as a high pressure and a low pressure, respectively. Typically, the high pressure is, for example, 2 to 3 MPa. The low pressure is, for example, 0.5 to 1.5 MPa, and is, for example, approximately 0.8 MPa.

The compressor 12 includes a plurality of compressor main bodies 16 and a common compressor casing 18 that accommodates the compressor main bodies 16. The plurality of compressor main bodies 16 are disposed inside the compressor casing 18 and are connected to the cold head 14 in parallel. The compressor 12 is also called a compressor unit.

The compressor main body 16 is configured to internally compress the working gas, which is sucked from a suction port thereof, and to discharge the working gas from a discharge port thereof. The compressor main body 16 may be, for example, a scroll type pump, a rotary type pump, or other pumps that pressurize the working gas. The compressor main body 16 may be configured to discharge the working gas at a fixed and constant flow rate. Alternatively, the compressor main body 16 may be configured to change the flow rate of the working gas to be discharged. The compressor main body 16 is called a compression capsule in some cases.

Although the compressor 12 has the two compressor main bodies 16 in the embodiment shown in FIG. 1, the number is not limited thereto. The compressor 12 may have three or more compressor main bodies 16 connected to the cold head 14 in parallel.

By operating the plurality of compressor main bodies 16 at the same time, the working gas can be supplied to the cold head 14 at a higher flow rate compared to a case where only one compressor main body 16 is operated. Accordingly, the cryocooler 10 can adopt the large cold head 14 that provides a larger cooling capacity.

Although details will be described later, the compressor 12 includes a plurality of state detection sensors 20 provided to correspond to the plurality of compressor main bodies 16, respectively. Each of the state detection sensors 20 detects a state of the corresponding compressor main body 16 and outputs a state detection signal S1. The compressor 12 is configured to, in a case where the state detection signal S1 from any one state detection sensor 20 of the plurality of state detection sensors 20 indicates that the corresponding compressor main body 16 is stopped, stop the other compressor main body 16 as well. The compressor 12 may be configured to output a stop command signal S2 to the compressor main bodies 16 based on the state detection signal S1. The compressor main bodies 16 are configured to be stopped in response to the stop command signal S2. The compressor main bodies 16 are switched from on to off in response to the stop command signal S2.

In addition, the compressor 12 includes a discharge port 22, a suction port 24, a discharge flow path 26, and a suction flow path 28. The compressor casing 18 accommodates the discharge flow path 26 and the suction flow path 28 in addition to the compressor main bodies 16.

The discharge port 22 is an outlet of the working gas that is provided in the compressor casing 18 in order to send the working gas, which is pressurized to a high pressure by the compressor main bodies 16, from the compressor 12, and the suction port 24 is an inlet of the working gas that is provided in the compressor casing 18 in order for the compressor 12 to receive the low-pressure working gas.

The discharge ports of the plurality of compressor main bodies 16 are connected to the discharge port 22 by the discharge flow path 26, and the suction port 24 is connected to the suction ports of the plurality of compressor main bodies 16 by the suction flow path 28. Accordingly, the discharge flow path 26 merges from the plurality of compressor main bodies 16 to the discharge port 22, and the suction flow path 28 is diverted from the suction port 24 to the plurality of compressor main bodies 16.

The discharge flow path 26 is configured to allow backflow. A check valve is not provided in the discharge flow path 26. Depending on a pressure difference between the discharge port of the compressor main body 16 and the discharge port 22, the working gas can flow in any one of a forward direction or a reverse direction of the discharge flow path 26. The arrow shown in FIG. 1 indicates the forward direction. In a normal operation state of the compressor 12 in which the plurality of compressor main bodies 16 are operating, the working gas flows from the discharge ports of the compressor main bodies 16 to the discharge port 22 in the forward direction of the discharge flow path 26. In this case, a pressure at the discharge port 22 becomes somewhat lower than a pressure at the discharge port of the compressor main body 16 due to a flow path resistance of the discharge flow path 26. In addition, since a pressure difference between the discharge port of one compressor main body 16 and the discharge port of the other compressor main body 16 does not occur substantially, the working gas does not mutually flow between the plurality of compressor main bodies 16.

However, when the pressure at the discharge port 22 is higher than the pressure at the discharge port of the compressor main body 16, the working gas can flow from the discharge port 22 to the discharge port of the compressor main body 16 in the reverse direction of the discharge flow path 26. In addition, when a pressure difference between the discharge port of the one compressor main body 16 and the discharge port of the other compressor main body 16 occurs, the working gas can flow in any direction depending on the pressure difference. When the one compressor main body 16 stops operating and the other compressor main body 16 continues operating for some reasons, the working gas can flow back to the one compressor main body 16 since the discharge port of the one compressor main body 16 has a pressure lower than the discharge port of the other compressor main body 16.

Similarly, the suction flow path 28 is configured to allow backflow. A check valve is not provided in the suction flow path 28. Depending on a pressure difference between the suction port of the compressor main body 16 and the suction port 24, the working gas can flow in any one of a forward direction or a reverse direction of the suction flow path 28. In the normal operation state of the compressor 12, the working gas flows from the suction port 24 to the suction ports of the compressor main bodies 16 in the forward direction of the suction flow path 28. In addition, when a pressure difference between the suction port of the one compressor main body 16 and the suction port of the other compressor main body 16 occurs, the working gas can flow in any direction depending on the pressure difference.

Each of the plurality of compressor main bodies 16 includes a compressor motor 30 and a motor current sensor which is an example of the state detection sensor 20. The motor current sensor is configured to be connected to the compressor motor 30 to detect a motor current flowing in the compressor motor 30, and to output a motor current signal which is an example of the state detection signal S1. The motor current sensor may be a non-contact type current sensor, for example, a current transformer (CT) type current sensor.

The state detection signal S1 indicates whether the corresponding compressor main body 16 is in an on state or an off state. In a case where the state detection sensor 20 is a motor current sensor, the state detection signal S1 indicates whether or not a current is flowing in the corresponding compressor motor 30, that is, whether the compressor motor 30 is turned on or off. In a case where the compressor motor 30 is turned on, the corresponding compressor main body 16 is operating (that is, in the on state). In a case where the compressor motor 30 is turned off, the corresponding compressor main body 16 is stopped (that is, in the off state).

The state detection sensor 20 is not limited to the motor current sensor. The state detection sensor 20 may be any type of sensor provided in the compressor motor 30 to output a voltage, a current, or other suitable electric signals indicating the on or off state of the compressor motor 30 as the state detection signal S1.

The compressor motor 30 may be, for example, an electric motor, or any other suitable type of motor. The compressor motor 30 may include a motor protection circuit 31, for example, a thermal relay. The motor protection circuit 31 may be configured to, for example, forcibly cut off power supply to the compressor motor 30 when a temperature of the compressor motor 30 has excessively increased during operation and to stop the compressor motor 30.

In addition, the cryocooler 10 includes a working gas line 32 that allows the working gas to circulate between the compressor 12 and the cold head 14. The working gas line 32 includes a high pressure line 33 through which the working gas is supplied from the compressor 12 to the cold head 14 and a low pressure line 34 through which the working gas is collected from the cold head 14 to the compressor 12. The room temperature section 14*a* of the cold head 14 includes a high pressure port 35 and a low pressure port 36. The high pressure port 35 is connected to the discharge port 22 by a high-pressure pipe 37, and the low pressure port 36 is connected to the suction port 24 by a low-pressure pipe 38. The high pressure line 33 includes the high-pressure pipe 37 and the discharge flow path 26, and the low pressure line 34 includes the low-pressure pipe 38 and the suction flow path 28.

Therefore, the working gas to be collected from the cold head 14 to the compressor 12 enters the suction port 24 of the compressor 12 from the low pressure port 36 of the cold head 14 through the low-pressure pipe 38, and further returns to the plurality of compressor main bodies 16 via the suction flow path 28 so as to be compressed and pressurized by each of the compressor main bodies 16. The working gas to be supplied from the compressor 12 to the cold head 14 exits from the discharge port 22 of the compressor 12 through the discharge flow path 26 from the plurality of compressor main bodies 16, and is further supplied into the cold head 14 via the high-pressure pipe 37 and the high pressure port 35 of the cold head 14.

The cryocooler 10 includes a compressor control unit 40 that controls the compressor 12. The compressor control unit 40 may be physically mounted on the compressor 12, or for example, may be attached to an outer surface of the compressor casing 18 or be accommodated in the compressor casing 18. Alternatively, the compressor control unit 40 may be physically separated from the compressor 12, and be connected by signal wiring for transmitting and receiving control signals (for example, the state detection signal S1 and the stop command signal S2) to and from the compressor 12.

The compressor control unit 40 is configured to, in a case where the state detection signal S1 from any one state detection sensor 20 of the plurality of state detection sensors 20 indicates that the corresponding compressor main body 16 is stopped, stop the other compressor main body 16 as well. The compressor control unit 40 is configured to, in a case where the state detection signal S1 from one state detection sensor 20 indicates that the corresponding compressor main body 16 is stopped, output the stop command signal S2 to all of the compressor main bodies 16 (or all of the other compressor main bodies 16).

The compressor control unit 40 is configured to, in a case where the state detection sensors 20 are motor current sensors and a case where a motor current signal from any one of the motor current sensors indicates that the corresponding compressor motor 30 is stopped, stop the other compressor motor 30 as well. The compressor control unit 40 is configured to, in a case where the state detection signal S1 from one motor current sensor indicates that the corresponding compressor motor 30 is stopped, output the stop command signal S2 to all of the compressor motors 30 (or all of the other compressor motors 30).

The compressor control unit 40 is electrically connected to each of the state detection sensors 20 to acquire the state detection signal S1 from each of the plurality of state detection sensors 20. In addition, the compressor control unit 40 is electrically connected to each of the compressor main bodies 16 (for example, the compressor motors 30) to supply the stop command signal S2 to each of the plurality of compressor main bodies 16.

The compressor control unit 40 may include a state determination unit 42 and a motor control unit 44.

The state determination unit 42 is configured to determine whether or not there is a disagreement between states (that is, the on state and the off state) of the plurality of compressor main bodies 16. The state determination unit 42 is configured to determine whether or not only one compressor main body 16 of the plurality of compressor main bodies 16 is turned off. The state determination unit 42 is configured to regularly receive the state detection signal S1 from each of the plurality of state detection sensors 20, and to determine whether or not the state detection signal S1 from at least one of the state detection sensors 20 indicates that the compressor motor 30 is stopped. The state determination unit 42 is configured to provide the determination result to the motor control unit 44.

The motor control unit 44 is configured to control the on or off state of each of the plurality of compressor motors 30 in accordance with the determination result from the state determination unit 42. The motor control unit 44 is configured to transmit the stop command signal S2 to each of the compressor motors 30 such that all of the compressor motors 30 are stopped in a case where the state determination unit 42 determines that at least one of the compressor motors 30 is stopped. The motor control unit 44 may be a motor driver or any other motor control circuit for controlling the compressor motors 30.

The compressor control unit 40 is realized by an element or a circuit including a CPU and a memory of a computer as a hardware configuration and is realized by a computer program as a software configuration, but the compressor control unit is shown in FIG. 1 as a functional block realized in cooperation therewith. It is clear for those skilled in the art that the functional blocks can be realized in various manners in combination with hardware and software.

Figure 2:
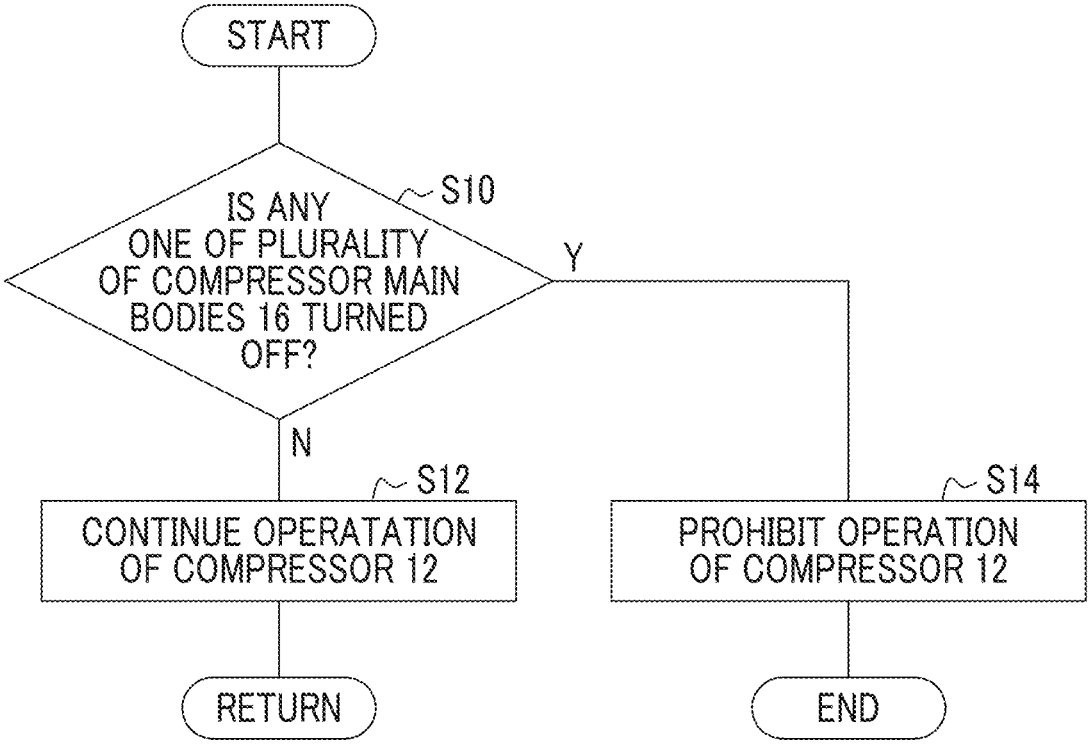
FIG. 2 is a flowchart showing an example of a compressor stopping process for the cryocooler according to the embodiment.

FIG. 2 is a flowchart showing an example of a compressor stopping process for the cryocooler 10 according to the embodiment. The compressor stopping process described below is repeatedly executed by the compressor control unit 40 at a predetermined cycle during the operation of the cryocooler 10. The compressor stopping process is applicable to the cryocooler 10 having the plurality of compressor main bodies 16 as in the cryocooler 10 shown in FIG. 1.

As shown in FIG. 2, the state determination unit 42 of the compressor control unit 40 determines whether or not any one compressor main body 16 of the plurality of compressor main bodies 16 is turned off (S10). Specifically, the state determination unit 42 determines whether or not the state detection signal S1 from any one state detection sensor 20 of the plurality of state detection sensors 20 indicates that the corresponding compressor motor 30 is turned off.

In a case where none of the compressor main bodies 16 are turned off, that is, in a case where the state detection signals S1 from all of the state detection sensors 20 indicate that the compressor motors 30 are turned on (N in S10), the state determination unit 42 allows the compressor 12 to continue to operate (S12). In this case, the motor control unit 44 does not output the stop command signal S2 to any one of the compressor motors 30. Accordingly, all of the compressor motors 30 are kept on, and all of the compressor main bodies 16 continue working gas compressing operation. In this manner, the compressor control unit 40 finishes the compressor stopping process. The compressor stopping process is executed again at a predetermined cycle as described above.

On the other hand, in a case where any one of the compressor main bodies 16 is turned off, that is, in a case where the state detection signal S1 from any one state detection sensor 20 of the plurality of state detection sensors 20 indicates that the corresponding compressor motor 30 is turned off (Y in S10), the state determination unit 42 prohibits the operation of the compressor 12 (S14). In this case, the motor control unit 44 outputs the stop command signal S2 to all of the compressor motors 30. Accordingly, all of the compressor motors 30 are switched to off, and all of the compressor main bodies 16 finish the working gas compressing operation. In this manner, the compressor control unit 40 finishes the compressor stopping process.

In a case where the motor protection circuit 31 is built in the compressor motor 30 as described above, the motor protection circuit 31 operates and only a specific compressor main body 16 can be stopped. In a typical configuration, the motor protection circuit 31 can operate independently of the compressor main body 16 by the compressor control unit 40 (that is, even when the compressor control unit 40 has commanded the compressor main body 16 to be turned on, the motor protection circuit 31 can ignore the command and switch the compressor main body 16 to off). In addition, in most cases, according to specifications thereof, the motor protection circuit 31 is configured such that the presence or absence of the operation is not output to the outside such as the compressor control unit 40. In this case, the operation stop of the compressor motor 30 or the compressor main body 16 caused by the operation of the motor protection circuit 31 is not directly detected by the compressor control unit 40.

Alternatively, the plurality of individual compressor main bodies 16 can stop abnormally, for example, due to various factors such as severe fluctuations that exceed assumptions on environments where the compressor is provided, including a temperature, humidity, and atmospheric pressure, and defects of cooling facilities of the compressor, including an abnormal cooling quality decrease of a refrigerant such as cooling water.

Even when only a specific compressor main body 16 is stopped for some reasons, the working gas can flow back from the discharge port of the operating compressor main body 16 to the discharge port of the stopped the compressor main body 16 since the other compressor main body 16 is operating at this time. Alternatively, the working gas can flow back from the suction port of the stopped compressor main body 16 to the suction port of the operating compressor main body 16. When such backflow of the working gas continuously occurs, unexpected inconvenience can occur, for example, an oil for cooling or lubricating the compressor main bodies 16 can excessively flow out from the discharge port or the suction port of the stopped compressor main body 16 together with the working gas. Accordingly, the backflow of the working gas is not desired.

By adding a backflow countermeasure component, such as a check valve, to the compressor 12, the backflow of the working gas can be prevented or mitigated. For example, the check valve can be disposed on each of a discharge side and a suction side for each of the compressor main bodies 16. However, since the check valve also functions as a flow path resistance, the check valve can cause a pressure loss in forward flow of the working gas and decrease a cooling performance of the cryocooler 10. In addition, the addition of a new component causes a rise in manufacturing costs.

The compressor 12 is configured to, in the cryocooler 10 according to the embodiment, in a case where the state detection signal S1 from any one state detection sensor 20 of the plurality of state detection sensors 20 indicates that the corresponding compressor main body 16 is stopped, stop the other compressor main body 16 as well. In this manner, when one of the compressor main bodies 16 abnormally stops, the other compressor main body 16 can be stopped synchronously by using the plurality of state detection sensors 20 provided to correspond to the plurality of compressor main bodies 16 respectively.

Therefore, even when one compressor main body 16 stops abnormally, the other compressor main body 16 can also be stopped promptly. The backflow of the working gas that can occur in the compressor 12 due to a disagreement between the on and off states of the plurality of compressor main bodies 16, such as some of the compressor main bodies 16 stop and the rest of the compressor main bodies 16 operate, can be mitigated or prevented. Even when the backflow occurs, the backflow occurs only temporarily or momentarily, and an effect of the backflow is slight. For this reason, since it is not necessary to add a backflow countermeasure component such as a check valve to the compressor 12, a pressure loss of the working gas that is assumed in a case where the backflow countermeasure component is added and the accompanying decrease in the cooling performance do not occur. In addition, since the backflow countermeasure component is not added, a rise in manufacturing costs can be suppressed.

In addition, a motor current sensor is used as the state detection sensor 20. With this, since the presence or absence of a motor current directly indicates the on or off state of the compressor motor 30, that is, the compressor main body 16, the on or off state of the compressor main body 16 can be reliably detected. In addition, the compressor main body 16 typically has the compressor motor 30 and the motor current sensor. Configuring a control system for simultaneously stopping the plurality of compressor main bodies 16 by using such existing components is advantageous in suppressing a rise in manufacturing costs, and mounting is also easy.

Figure 3:
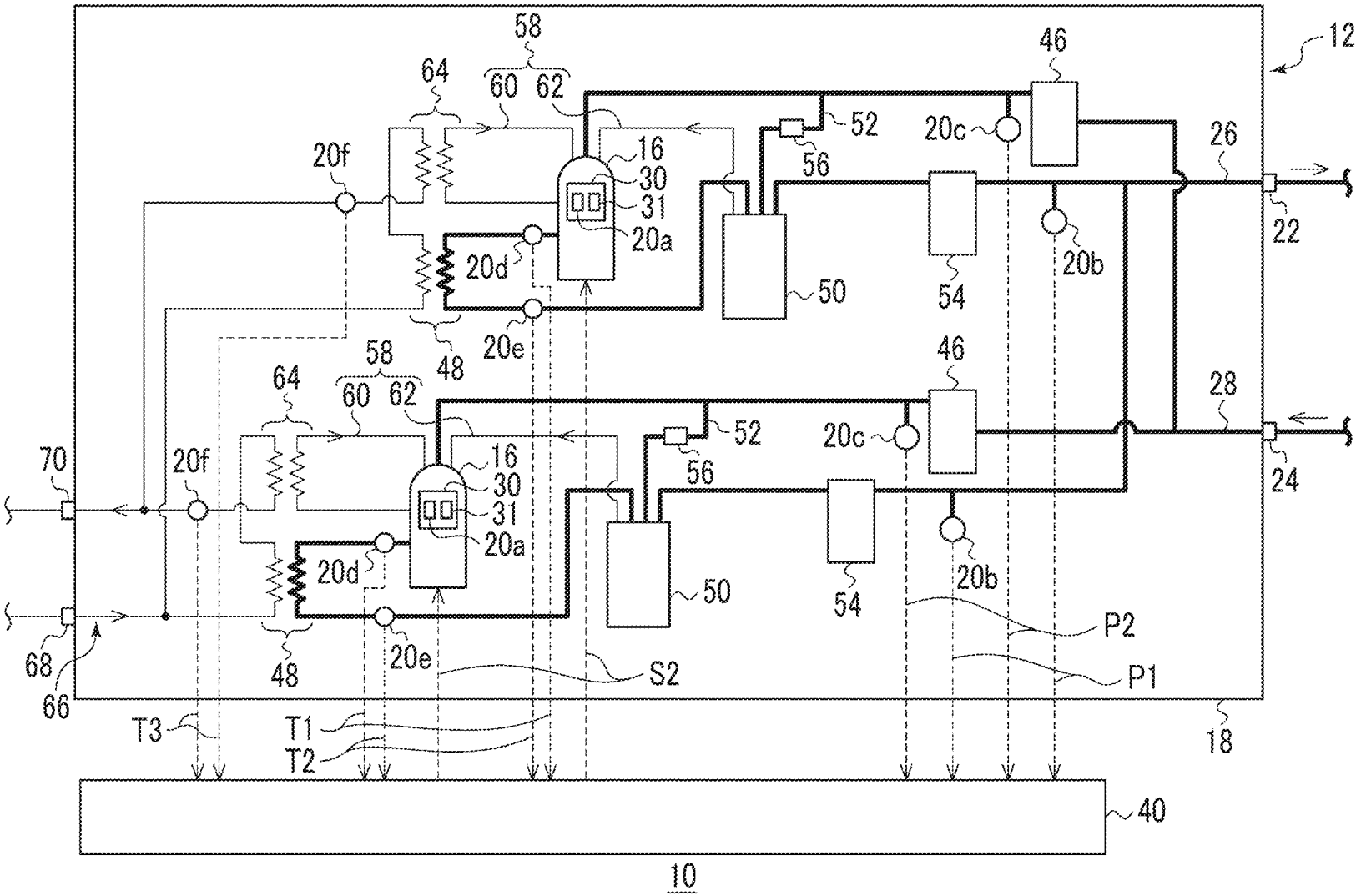
FIG. 3 is a schematic diagram showing an example of a configuration of a compressor that can be adopted in the cryocooler according to the embodiment.

FIG. 3 is a schematic diagram showing an example of a configuration of the compressor 12 that can be adopted in the cryocooler 10 according to the embodiment. Similar to the compressor 12 shown in FIG. 1, the compressor 12 shown in FIG. 3 includes the plurality of compressor main bodies 16 and the common compressor casing 18 that accommodates the compressor main bodies 16. Each of the compressor main bodies 16 includes the compressor motor 30. The compressor motor 30 may include or may not include a motor current sensor 20*a*, which is an example of the state detection sensor, and the motor protection circuit 31. In addition, the compressor 12 includes the discharge port 22, the suction port 24, the discharge flow path 26, and the suction flow path 28. The components already described with reference to FIG. 1 will be assigned with the same reference signs in FIG. 3, and redundant description will be omitted as appropriate.

In FIG. 3, for easy understanding, the flow paths of the working gas are shown with thick lines, and a flow path of an oil and a flow path of a refrigerant are shown with thin lines respectively.

In the embodiment shown in FIG. 3, the compressor 12 includes a storage tank 46, a working gas cooling unit 48, an oil separator 50, a bypass flow path 52, and an adsorber 54 for each of the plurality of compressor main bodies 16. The working gas cooling unit 48, the oil separator 50, and the adsorber 54 are disposed in the discharge flow path 26, and the storage tank 46 is disposed in the suction flow path 28.

The storage tank 46 is provided as a volume for removing pulsation included in the low-pressure working gas returning from the cold head 14 to the compressor 12. The working gas cooling unit 48 is provided in order to cool the high-pressure working gas heated by compression heat generated through the compression of the working gas in the compress or main body 16. The oil separator 50 is provided in order to separate an oil mixed in the working gas out from the working gas by causing the working gas to pass through the compressor main body 16. The adsorber 54 is provided in order to remove, for example, a vaporized oil and other contaminants remaining in the working gas from the working gas through adsorption.

The working gas flowing into the compressor 12 from the suction port 24 is collected into the suction port of the compressor main body 16 via the storage tank 46 on the suction flow path 28. Since the storage tank 46 is provided for each of the compressor main bodies 16 as described above, the suction flow path 28 is branched between the suction port 24 and the storage tank 46.

The working gas sent from the discharge port of the compressor main body 16 exits the compressor 12 from the discharge port 22 via the working gas cooling unit 48, the oil separator 50, and the adsorber 54 on the discharge flow path 26. The discharge flow path 26 merges between the adsorber 54 and the discharge port 22.

The bypass flow path 52 connects the discharge flow path 26 to the suction flow path 28 to bypass the corresponding compressor main body 16. For example, the bypass flow path 52 connects the oil separator 50 between the storage tank 46 and the compressor main body 16. At least one bypass valve 56 is disposed in the by pass flow path 52. The by pass valve 56 is provided in order to control the flow rate of the working gas in the bypass flow path 52 and/or in order to equalize pressures of the discharge flow path 26 and the suction flow path 28 when the compressor 12 is stopped.

The compressor 12 includes an oil line 58 that allows an oil to be circulated for each of the plurality of compressor main bodies 16. The oil flowing in the oil line 58 is used for cooling and/or lubricating the compressor main body 16. The oil lines 58 of the respective compressor main bodies 16 are separated from each other. That is, the oil does not flow between the oil lines 58.

Providing the oil line 58 individually for each of the compressor main bodies 16 helps maintain an appropriate amount of oil in each of the oil lines 58. When the oilcan flow between the plurality of oil lines 58, the oil flows from one of the oil lines 58 to the other oil line 58 during the operation of the compressor 12, and an imbalance of the amounts of oil can occur between the plurality of oil lines 58. However, in a case where such an imbalance of the amounts of oil falls within an allowable range, the plurality of oil lines 58 may be connected to each other.

The oil line 58 includes an oil circulation line 60 and an oil return line 62. The oil circulation line 60 has an oil cooling unit 64. The oil circulation line 60 is configured such that an oil flowing out from the compressor main body 16 is cooled by the oil cooling unit 64 and flows into the compressor main body 16 again. The oil return line 62 connects the oil separator 50 to the compressor main body 16 in order to return the oil collected by the oil separator 50 to the compressor main body 16.

The compressor 12 includes a cooling system 66 that cools the compressor main bodies 16, for example, using a refrigerant such as cooling water. The cooling system 66 includes the working gas cooling units 48 and the oil cooling units 64. The working gas cooling unit 48 cools the working gas through heat exchange between the working gas compressed by the compressor main body 16 and the refrigerant. In addition, the oil cooling unit 64 cools the oil through heat exchange between the oil flowing out from the compressor main body 16 and the refrigerant.

The cooling system 66 has a refrigerant inlet port 68 and a refrigerant outlet port 70 which are provided in the compressor casing 18, and a refrigerant supplied from the refrigerant inlet port 68 is discharged from the refrigerant outlet port 70 via the working gas cooling units 48 and the oil cooling units 64. The refrigerant exiting from the refrigerant outlet port 70 may be cooled by, for example, a chiller (not shown) and be supplied again to the refrigerant inlet port 68. In this manner, compression heat generated by the compressor main bodies 16 is removed to the outside of the compressor 12 together with the refrigerant.

In addition, the compressor 12 includes some sensors that can be used as the plurality of state detection sensors provided to correspond to the plurality of compressor main bodies 16 respectively. The compressor 12 includes a first pressure sensor 20*b*, a second pressure sensor 20*c*, a first temperature sensor 20*d*, a second temperature sensor 20*e*, and a third temperature sensor 20*f* for each of the plurality of compressor main bodies 16.

The first pressure sensor 20*b* is configured to detect a pressure of the working gas discharged from the corresponding compressor main body 16 and to output a first pressure detection signal P1 as a state detection signal. The first pressure sensor 20*b* is disposed in the discharge flow path 26 between the adsorber 54 and the discharge port 22 to measure the pressure of the working gas. The second pressure sensor 20*c* is configured to detect the pressure of the working gas to be sucked into the corresponding compressor main body 16 and to output a second pressure detection signal P2 as a state detection signal. The second pressure sensor 20*c* is disposed in the suction flow path 28 between the storage tank 46 and the compressor main body 16 to measure the pressure of the working gas.

The first temperature sensor 20*d* and the second temperature sensor 20*e* are configured to detect a temperature of the working gas discharged from the corresponding compressor main body 16 and to output temperature detection signals (T1 and T2) as state detection signals. The first temperature sensor 20*d* is disposed in the discharge flow path 26 between the compressor main body 16 and the working gas cooling unit 48 to measure the temperature of the working gas, and the second temperature sensor 20*e* is disposed in the discharge flow path 26 between the working gas cooling unit 48 and the oil separator 50 to measure the temperature of the working gas.

The third temperature sensor 20*f* is configured to detect a temperature of a refrigerant that cools the working gas discharged from the corresponding compressor main body 16 and to output a temperature detection signal T3 as a state detection signal. For example, the third temperature sensor 20*f* is disposed in the cooling system 66 between the oil cooling unit 64 and the refrigerant outlet port 70 to measure the temperature of the refrigerant.

The first pressure sensor 20*b*, the second pressure sensor 20*c*, the first temperature sensor 20*d*, the second temperature sensor 20*e*, and the third temperature sensor 20*f* are connected to output the state detection signals (P1, P2, and T1 to T3) to the compressor control unit 40.

The first pressure detection signal P1 from the first pressure sensor 20*b* indicates the pressure of the working gas discharged from the corresponding compressor main body 16. Accordingly, when the compressor main body 16 is stopped, the first pressure detection signal P1 indicates a pressure lower than a pressure during the operation of the compressor main body 16. The second pressure detection signal P2 from the second pressure sensor 20*c* indicates the pressure of the working gas discharged from the corresponding compressor main body 16. Accordingly, when the compressor main body 16 is stopped, the second pressure detection signal P2 indicates a pressure higher than the pressure during the operation of the compressor main body 16. Similarly, the temperature detection signals (T1, T2, and T3) from the first temperature sensor 20*d*, the second temperature sensor 20*e*, and the third temperature sensor 20*f* also indicate temperatures different from a temperature during the operation of the compressor main body 16 when the corresponding compressor main body 16 is stopped.

The compressor control unit 40 is configured to, in a case where the state detection signal (P1, P2, or T1 to T3) from any one state detection sensor (20*a* to 20*f*) of the plurality of state detection sensors (20*a* to 20*f*) indicates that the corresponding compressor main body 16 is stopped, stop the other compressor main body 16 as well. The compressor control unit 40 is configured to, in a case where the state detection signal (P1, P2, or T1 to T3) from one state detection sensor (20*a* to 20*f*) indicates that the corresponding compressor main body 16 is stopped, output the stop command signal S2 to all of the compressor main bodies 16 (or all of the other compressor main bodies 16).

The compressor control unit 40 may be configured to determine a state of the corresponding compressor main body 16 from the state detection signal from one type of sensor of the motor current sensor 20*a*, the first pressure sensor 20*b*, the second pressure sensor 20*c*, the first temperature sensor 20*d*, the second temperature sensor 20*e*, and the third temperature sensor 20*f*. Alternatively, the compressor control unit 40 may be configured to determine a state of the corresponding compressor main body 16 from the state detection signal from a plurality of types of sensors of the motor current sensor 20*a*, the first pressure sensor 20*b*, the second pressure sensor 20*c*, the first temperature sensor 20*d*, the second temperature sensor 20*e*, and the third temperature sensor 20*f*.

In this manner, when one of the compressor main bodies 16 abnormally stops, the other compressor main body 16 can be stopped synchronously by using various sensors mounted on the compressor 12. The backflow of the working gas that can occur in the compressor 12 due to a disagreement between the on and off states of the plurality of compressor main bodies 16 can be mitigated or prevented. Similar to the embodiment shown in FIG. 1, the embodiment shown in FIG. 3 also provides a countermeasure against the backflow of the working gas while suppressing a rise in manufacturing costs.

In addition, some components of the compressor 12 may be shared by the plurality of compressor main bodies 16. By doing so, the number of components can be reduced and manufacturing costs can be suppressed.

Figure 4:
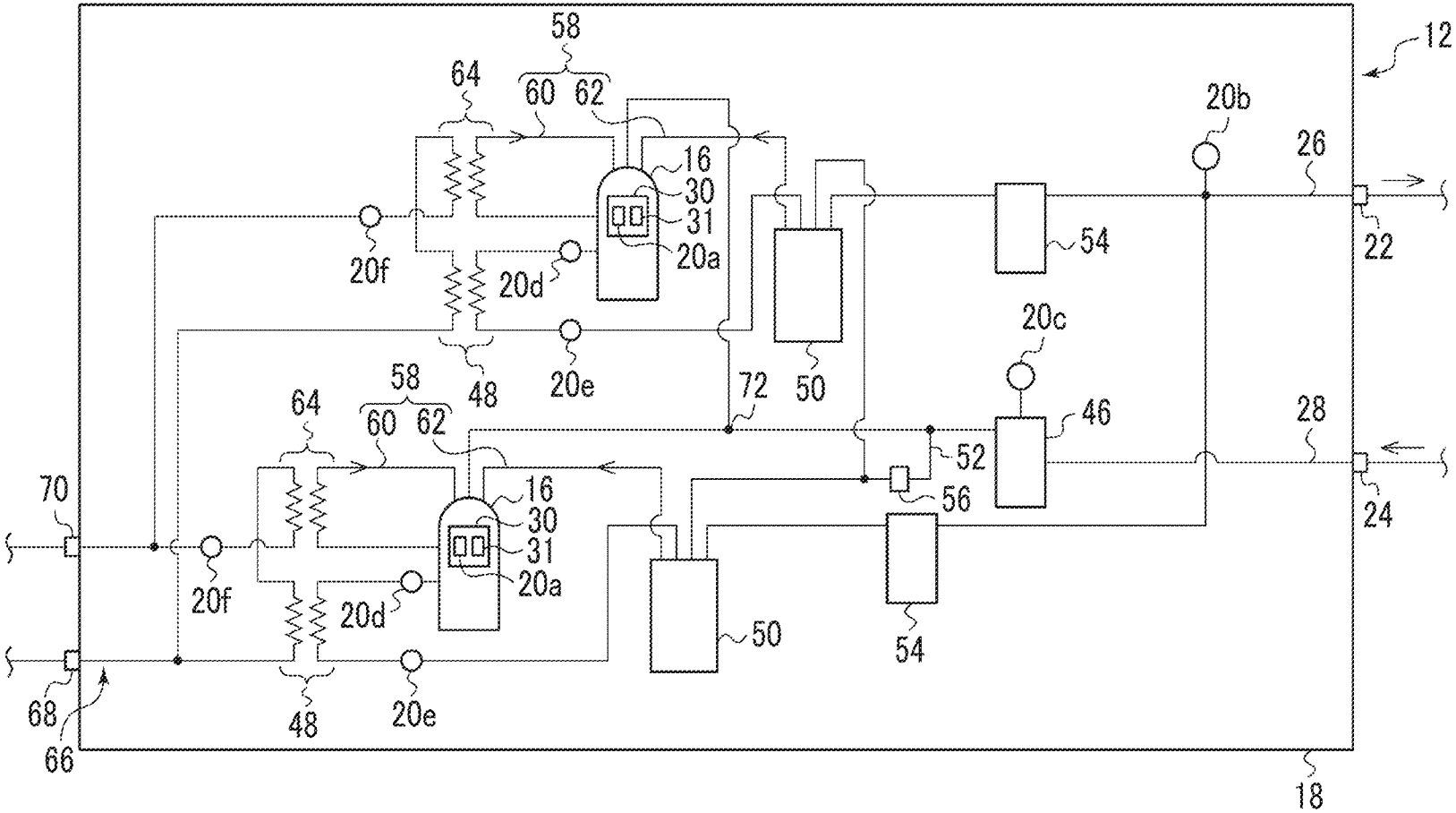
FIG. 4 is a schematic diagram showing another example of the configuration of the compressor that can be adopted in the cryocooler according to the embodiment.

FIG. 4 is a schematic diagram showing another example of the configuration of the compressor 12 that can be adopted in the cryocooler 10 according to the embodiment. In the embodiment shown in FIG. 4, some components provided in the suction flow path 28 are shared by the plurality of compressor main bodies 16. The rest of the configuration is the same as the embodiment described above, and the same reference signs will be assigned in FIG. 4 as well, and redundant description will be omitted as appropriate.

The compressor 12 may include the common storage tank 46 provided in the suction flow path 28 between the suction port 24 and a diverting portion 72 to the plurality of compressor main bodies 16. In addition, also the first pressure sensor 20*b*, the second pressure sensor 20*c*, and the bypass valve 56 may be shared by the plurality of compressor main bodies 16.

Figure 5:
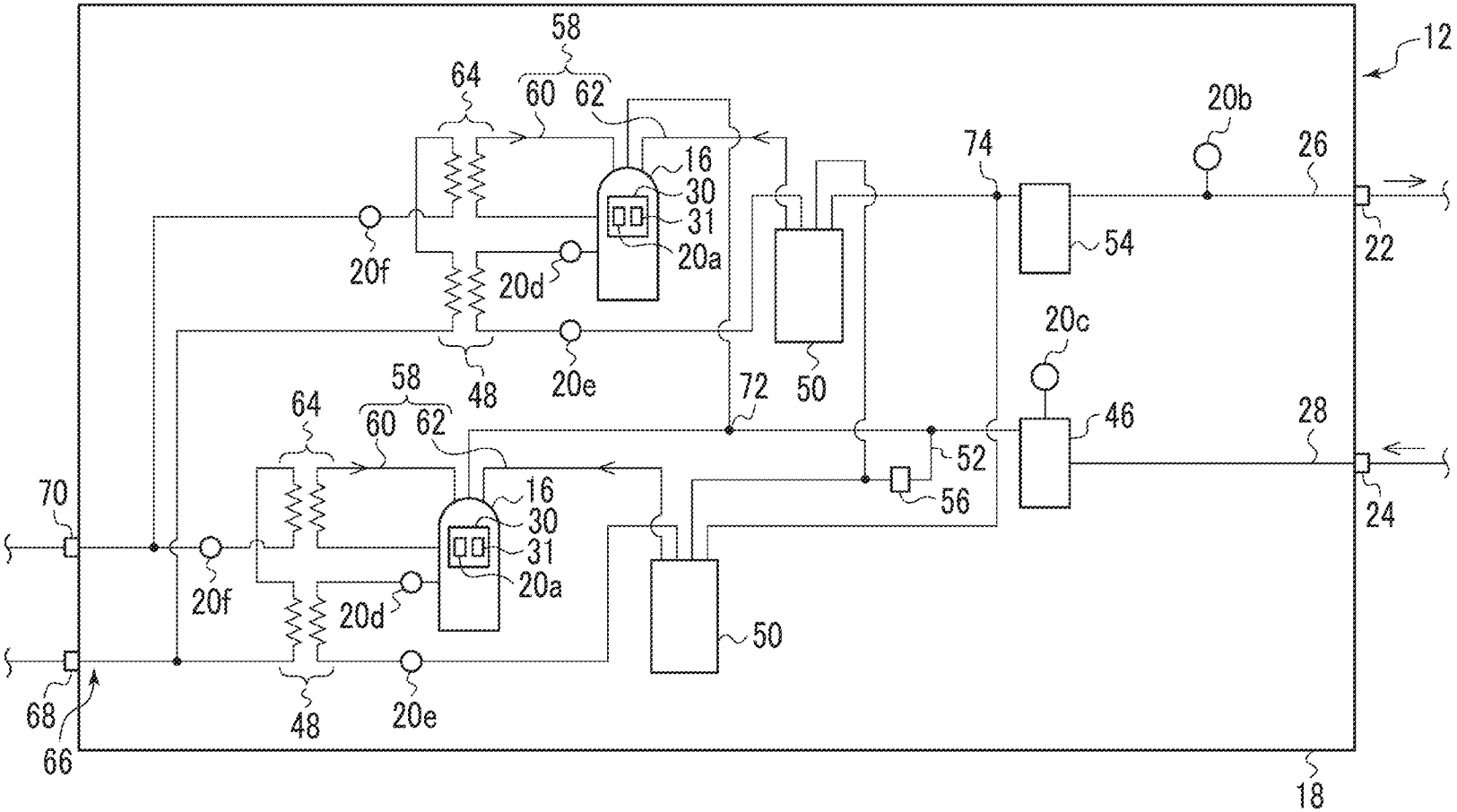
FIG. 5 is a schematic diagram showing still another example of the configuration of the compressor that can be adopted in the cryocooler according to the embodiment.

FIG. 5 is a schematic diagram showing still another example of the configuration of the compressor 12 that can be adopted in the cryocooler 10 according to the embodiment. In the embodiment shown in FIG. 5, some components provided in the discharge flow path 26 are shared by the plurality of compressor main bodies 16. The rest of the configuration is the same as the embodiment described above, and the same reference signs will be assigned in FIG. 5 as well, and redundant description will be omitted as appropriate.

The compressor 12 may include the common adsorber 54 provided in the discharge flow path 26 between a merging portion 74 from the plurality of compressor main bodies 16 and the discharge port 22.

The present invention has been described hereinbefore based on the embodiment. It is clear for those skilled in the art that the present invention is not limited to the embodiments, various design changes are possible, various modification examples are possible, and such modification examples are also within the scope of the present invention.

Various characteristics described related to one embodiment are also applicable to other embodiments. A new embodiment generated through combination also has the effects of each of the combined embodiments.

Although the plurality of compressor main bodies 16 are accommodated in the single compressor casing 18 in the embodiment, the invention is not limited thereto. Each of the compressor main bodies 16 may be accommodated in a separate compressor casing. Accordingly, the compressor 12 may include the plurality of compressor main bodies 16 connected to the cold head 14 in parallel and a plurality of compressor casings that each accommodate one compressor main body 16.

It is possible to use the present invention in the field of cryocoolers.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

a cold head;

a plurality of compressor main bodies connected to the cold head in parallel;

a plurality of state detection sensors configured to:

correspond to the compressor main bodies respectively, and each detect a state of a corresponding compressor main body to output a state detection signal; and a compressor controller configured to:

stop, in a case where the state detection signal from any one state detection sensor of the plurality of state detection sensors indicates that the corresponding compressor main body abnormally stops, other compressor main bodies that are normally operated, and allow, in a case where the state detection signals from all of the plurality of state detection sensors indicate that the corresponding compressor main bodies are operated, all of the compressor main bodies to continue to operate.

2. The cryocooler according to claim 1, wherein each of the compressor main bodies includes:

a compressor motor, and a motor current sensor that is the state detection sensor, which detects a motor current flowing in the compressor motor and outputs a motor current signal, and wherein the compressor controller is configured to:

stop, in a case where the motor current signal from any one of the motor current sensors indicates that the corresponding compressor motor stops, the other compressor motors.

3. The cryocooler according to claim 1, wherein the state detection sensor comprises a pressure sensor that detects a pressure of a working gas discharged or sucked from the corresponding compressor main body and outputs a pressure detection signal as the state detection signal.

4. The cryocooler according to claim 1, wherein the state detection sensor comprises a temperature sensor that detects a temperature of a working gas discharged from the corresponding compressor main body or a temperature of a refrigerant, which cools the working gas discharged from the corresponding compressor main body, and outputs a temperature detection signal as the state detection signal.

5. The cryocooler according to claim 1, further comprising:

a common compressor casing that has a discharge port and a suction port and accommodates the plurality of compressor main bodies;

a discharge flow path that merges from the plurality of compressor main bodies to the discharge port; and a suction flow path that diverts from the suction port to the plurality of compressor main bodies, wherein both of the discharge flow path and the suction flow path are configured to allow backflow.

6. The cryocooler according to claim 5, wherein the suction flow path comprises a common storage tank provided between the suction port and a diverting portion to the plurality of compressor main bodies.

7. The cryocooler according to claim 5, wherein the discharge flow path comprises a common adsorber provided between a merging portion from the plurality of compressor main bodies and the discharge port.

* * * * *